US007421765B1

(12) United States Patent
Kaiser

(10) Patent No.: US 7,421,765 B1
(45) Date of Patent: Sep. 9, 2008

(54) CREMATION BURIAL SYSTEM

(76) Inventor: Patrick G. Kaiser, 4191 Parker Rd., Davisburg, MI (US) 48350

( * ) Notice: Subject to any disclaimer, the term of this patent is extended or adjusted under 35 U.S.C. 154(b) by 0 days.

(21) Appl. No.: 11/811,371

(22) Filed: Jun. 11, 2007

(51) Int. Cl.
*A61G 17/00* (2006.01)

(52) U.S. Cl. ..... 27/1; 27/35; 52/128

(58) Field of Classification Search ..... 27/1, 27/35; 52/103–104, 128, 133–134, 136, 52/309.12, 314; 40/124.5
See application file for complete search history.

(56) References Cited

U.S. PATENT DOCUMENTS 3,868,799 A * 3/1975 Hayward ..... 52/131
4,875,622 A * 10/1989 Lents ..... 232/39
5,261,199 A * 11/1993 Schmidt ..... 52/141
5,287,603 A * 2/1994 Schorman ..... 27/1
6,269,526 B1 * 8/2001 Bischoff et al. ..... 27/35
7,163,140 B1 * 1/2007 Kaiser ..... 232/38
7,287,306 B1 * 10/2007 Green ..... 27/1

* cited by examiner

*Primary Examiner*—William L. Miller
(74) *Attorney, Agent, or Firm*—Alex Rhodes

(57) ABSTRACT

An aesthetically pleasing vault and urn system for use in a memorial service and/or interring the cremated remains of persons and/or pets. The vault and urn are weatherproof and tamperproof closures that prevent unauthorized access to the cremated remains. The urn can be used alone or in combination with the vault. The vault and urn are covered with materials capable of resisting deterioration for extended periods of time. In one embodiment, the vault simulates the appearance of a traditional gravestone mounted on a concrete or mounted side-by-side with a second simulated traditional gravestone for holding the remains of a husband and wife, a pet and its owner or close friends.

17 Claims, 8 Drawing Sheets

CREMATION BURIAL SYSTEM

FIELD OF THE INVENTION

This invention relates to burial systems and more particularly to a vault and urn for honoring and preserving the cremated remains of humans and pets.

BACKGROUND OF THE INVENTION

Cremation is a low cost alternative to the practices of embalming and interring human remains in expensive caskets and cemetery plots. It is an ancient practice which dates back in the archaeological record at least 26,000 years. Traces of cremation have been found in Europe dating to the Early Bronze Age (ca. 2000BC).

From 1997 to 2001, the percentage of confirmed cremated deaths in the United States have risen from 23.13% to 36.03% of all deaths. The rate is projected to increase to 43.57% by the year 2025. A survey published in 2003 showed a rate of cremation in the United States between 1997 to 2001 ranging from a high of 55.20% in Nevada to a low of 4.43% in Alaska.

A 1996/97 Report of the Cremation Association of North America shows that in 1996, 40.7% of cremation remains were delivered to a cemetery, 35.8% were taken home, 17.8% were scattered as directed and 5.7% were not picked up. Fifty-seven percent of the remains delivered to cemeteries were buried, 25.6% were placed in columbariums, 15.2% were scattered on dedicated properties and the remainder were placed in common graves.

The death of a pet or family member is an emotionally challenging event. One major deficiency with the current cremation practice is the lack of a suitable means for honoring and preserving the cremated remains of a person or pet. Another deficiency is the lack of a weatherproof closure for preserving the cremated remains of a person or pet outdoors.

SUMMARY OF THE INVENTION

The principal objects of the present invention are to provide an improved means for honoring and preserving the cremated remains of humans and pets. One benefit of the invention is that it provides a variety of attractive enclosures without incurring high investment costs. Another benefit is that it provides weatherproof enclosures for preserving the remains of a person or pet. Another benefit is that it can be used to simulate traditional funeral practices. Another benefit is that it provides a weather resistant depository for the outdoor storage of cremated remains. Another benefit is that it provides a low cost means for side-by-side positioning of the remains of spouses and owners and pets.

The invention is comprised of an assembly of a weatherproof cremation urn and burial vault. The urn and vault are hermetically sealed closures made of rigid polyfoam plastic cores covered with aggregate coatings. Included are decorative interior liners, exterior handles, religious inscriptions and identification plaques. In a first aspect, the burial vault and urn are adapted to be displayed during a memorial service and stored below ground. In a second aspect, the vault and urn are adapted to rest above ground at a grave site, in a garden or in a columbarium.

In employing the teaching of the present invention, a plurality of alternate constructions can be provided to achieve the desired results and capabilities. In this disclosure, only several embodiments are presented for the purpose of disclosing my invention. However, these embodiments are intended as examples only and should not be considered as limiting the scope of my invention.

The foregoing features, benefits, objects and best mode of practicing the invention and additional benefits and objects will become apparent from the ensuing detailed description of a preferred embodiment and the subject matter in which exclusive property rights are claimed is set forth in the numbered claims which are appended to the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF A PREFERRED EMBODIMENT

Figure 1:
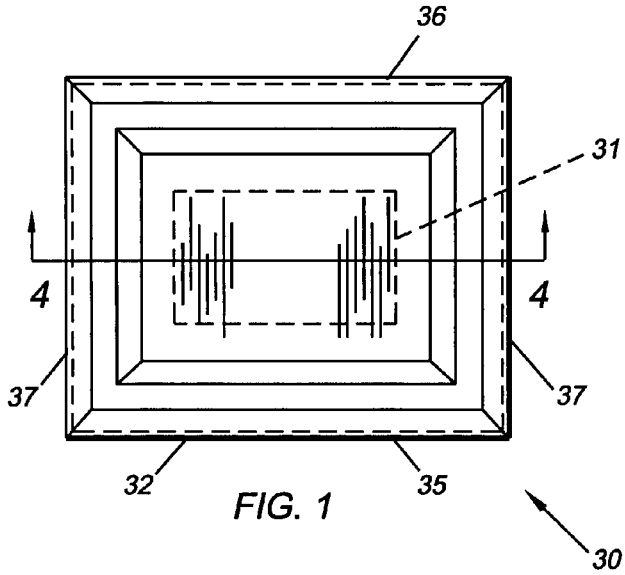
FIG. 1 is a plan view of a cremation vault and urn according to my invention.
Figure 2:
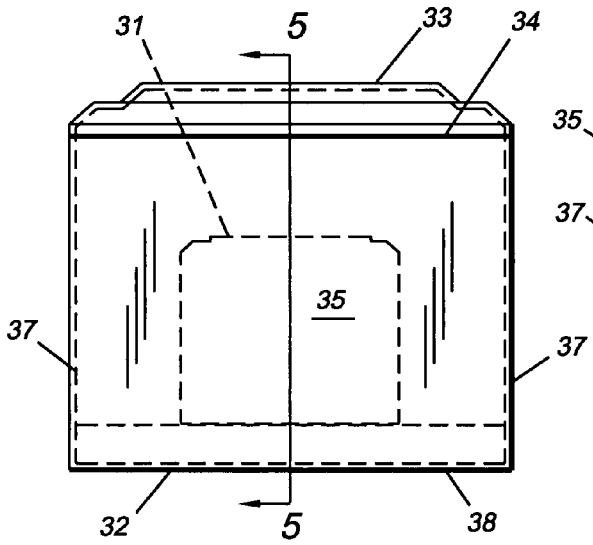
FIG. 2 is a front view of the cremation vault and urn.
Figure 3:
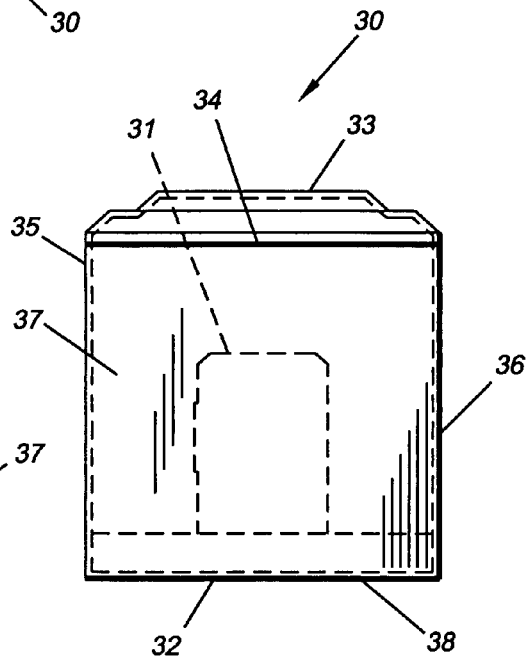
FIG. 3 is a left elevational view of the cremation vault and urn.
Figure 6:
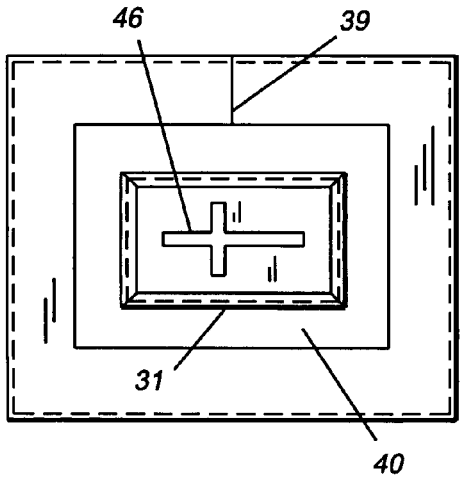
FIG. 6 is a cross-sectional view taken on the line 6-6 in FIG. 4.
Figure 4:
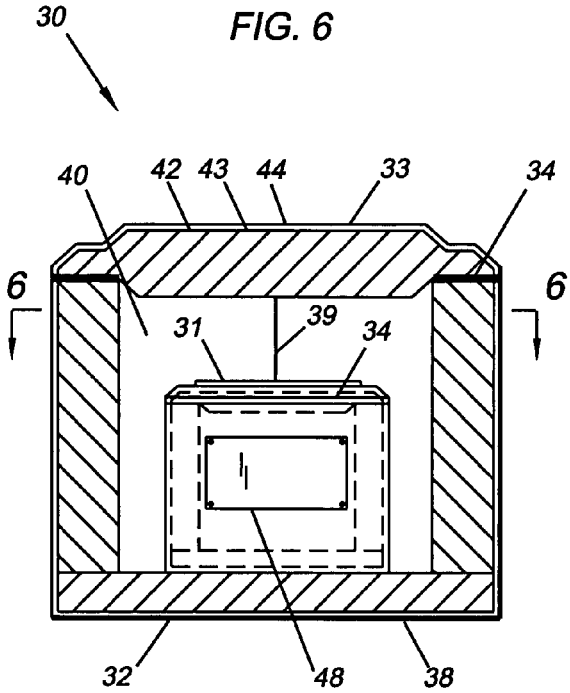
FIG. 4 is a cross-sectional view taken on the line 4-4 in FIG. 1.
Figure 5:
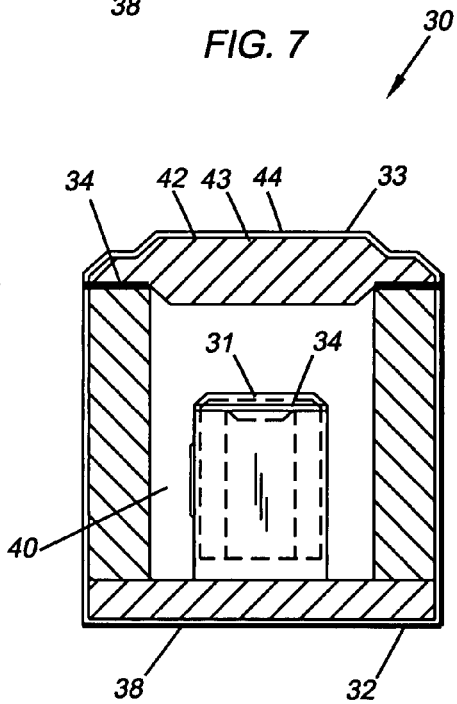
FIG. 5 is a cross-sectional view taken on the line 5-5 in FIG. 2.

Referring now to the drawings wherein like numerals designate like and corresponding parts throughout the several views, in FIGS. 1 through 10, inclusive, an assembly 30 of a cremation vault 32 and urn 31, are shown according to the present invention. One feature of the invention is that the urn 31 can be used without the vault 32. The vault 32 is a rectangular hermetically sealed enclosure with a cover 33 that is adhesively attached. The vault 32 is comprised of an open top 34, front 35, rear 36, sides 37 and bottom 38 portions. The front 35, rear 36 and sides 37 are cut with a hot wire from a rectangular expanded polystyrene (EPS) block or in the alternative assembled from separate panels or molded. In the case of a hot wire cut block or an assembly of separate panels, the bottom panel 38 is adhesively joined to the front 35, rear 36 and sides 37 of the vault 32. With reference to FIGS. 4 and 6, the hot wire enters the vault 32 along the line 39 to cut out the hollow interior 40. The cover 33 is joined with an adhesive after the cremated remains of a pet or person are added.

In the interior 40 of the vault 32 is a rectangular shaped urn 31 for receiving the cremated remains of the person or pet. The urn 31 is constructed in the same manner as the vault 32. Although the vault 32 and urn 31 can be any size, typical sizes of the vault 32 and urn 31 are as follows. A typical vault 32, including a cover 33, is 20 inches wide by 16¾ inches deep by 19 inches high. A typical urn 31, including a cover 33, is 9.00 inches wide by 8.00 inches deep by 9.00 inches high.

With reference to FIGS. 4, 5, 9 and 10, after the vault 32 and urn 31 are assembled, a reinforcing cloth 42 is applied with an adhesive to the exterior surfaces of the vault 32 and urn 31. The final step consists of applying decorative coatings 43 to the exteriors to simulate cut stone and other materials. This can be done in two ways. The exterior coatings 43 can consist of separate tiles on the front 35, sides 37, rear 36 and bottoms 38 of the vault 32 and urn 31. A second way is to spray or trowel coatings on the exteriors of the vault 32 and urn 31 in the following manner. A colorant is mixed with a cement coating and a thin mixture 43 is sprayed or troweled over outer surfaces of the vault 32 and urn 31 and allowed to dry. Drying can be accelerated by placing the vault 32 and urn 31 in a warm air oven for several minutes. In the case of simulated cut or irregular shaped stone or bricks, the thin coating is used to simulate grout between stone and brick After the thin base coating 43 has dried, a finish coating 44 is applied to simulate a stone, such as marble, granite or limestone. In the case of simulated brick, cut stone or irregular stone finishes, stencils with cut-outs that simulate spaces between the bricks or stones are applied to the outer surfaces of the vault 32 and urn 31 and a thick coating 44 consisting of a mixture of a cement and colorant is applied over the stencil to simulate a brick, stone or other surface. The stencils are removed to simulate the grout lines between the bricks and stones.

The finish coating 44 may also be a traditional stucco coating or one of the recently introduced plastic base finishes. One suitable plastic base finish is available from Dryvit Systems, Inc. of West Warick, R. I. Dryvit finishes are available in a wide range of decorative finishes. The Dryvit finishes are composite finishes containing acrylic polymers and filler materials, such as Portland cement plaster, stucco and fiber modified plasters, or stone aggregates. By way of example, the "Amerstone™" Dryvit finish is a 100% acrylic-based finish with multi-colored quartz aggregates.

Before applying a Dryvit coating, the manufacturer recommends that the "substrate" (thin underlying coating 43) be clean, free of oil, grease and dirt, salts, etc. and that it should be dampened. The following is exemplary of a procedure for applying a Dryvit coating, specifically the Dryvit AC-100 coating with Portland cement plaster or one-coat stucco. For Portland cement plasters and stucco, one part AC-100 coating is pre-blended with 2 to 3 parts water. After mixing the pre-blended mixture with Portland cement plaster or one-coat stucco and aggregates, the mixture is applied in the same manner as an unmodified mixture.

Figure 7:
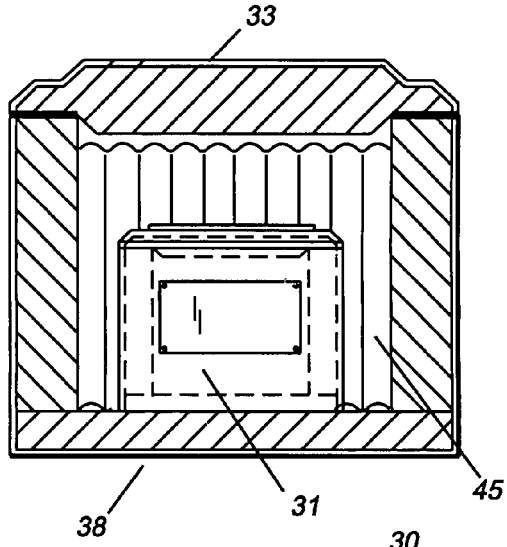
FIG. 7 is a cross-sectional view taken in the same manner as FIG. 4 of the vault with a decorative liner.
Figure 8:
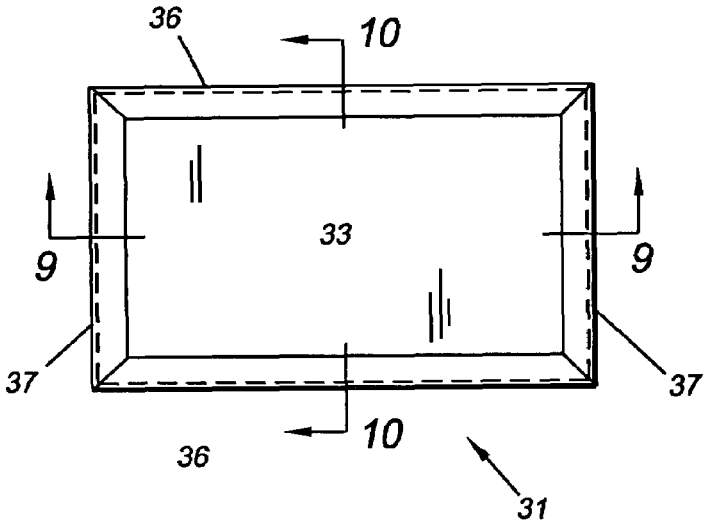
FIG. 8 is an enlarged plan view of the cremation urn.
Figure 9:
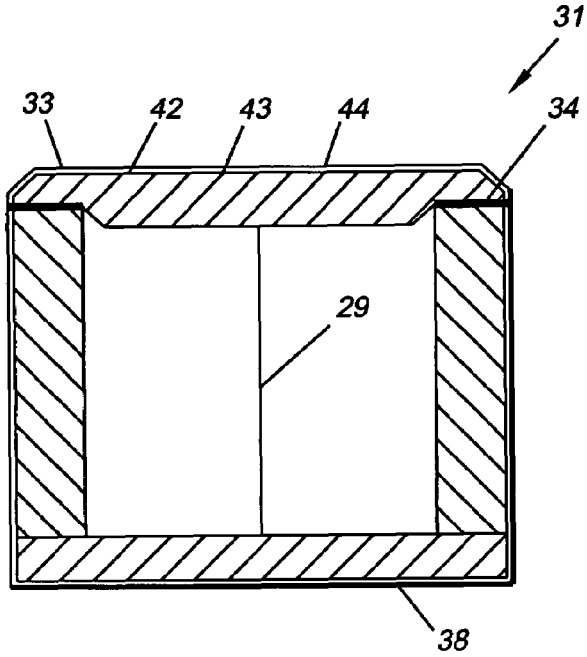
FIG. 9 is a cross-sectional view taken on the line 9-9 in FIG. 8.
Figure 10:
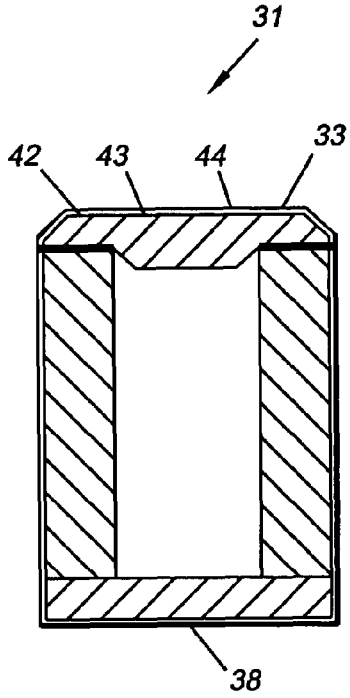
FIG. 10 is a cross-sectional view taken on the line 10-10 in FIG. 8.

In FIG. 7, a decorative fabric interior liner 45 is shown for enhancing the appearance of the interior of the vault 32. In FIG. 6, a religious inscription 46 is shown on the cover 33 of the urn 31. FIGS. 8 through 10 are enlarged plan and cross-sectional views of the urn 31.

Figure 11:
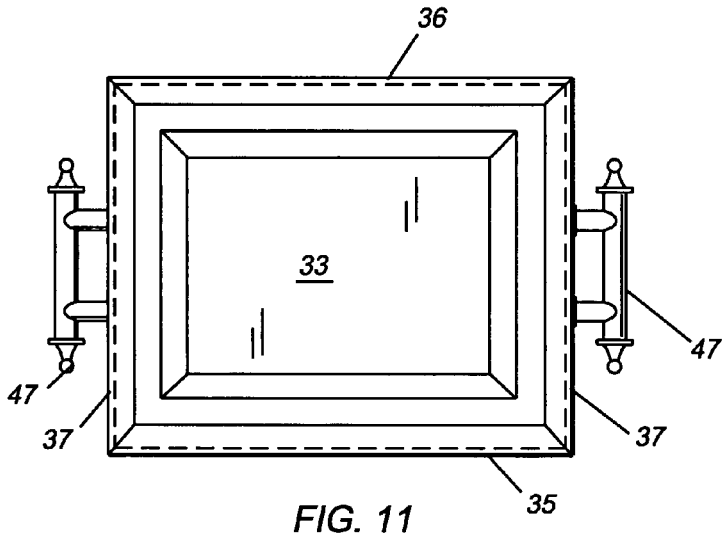
FIG. 11 is a plan view of a deluxe embodiment.
Figure 12:
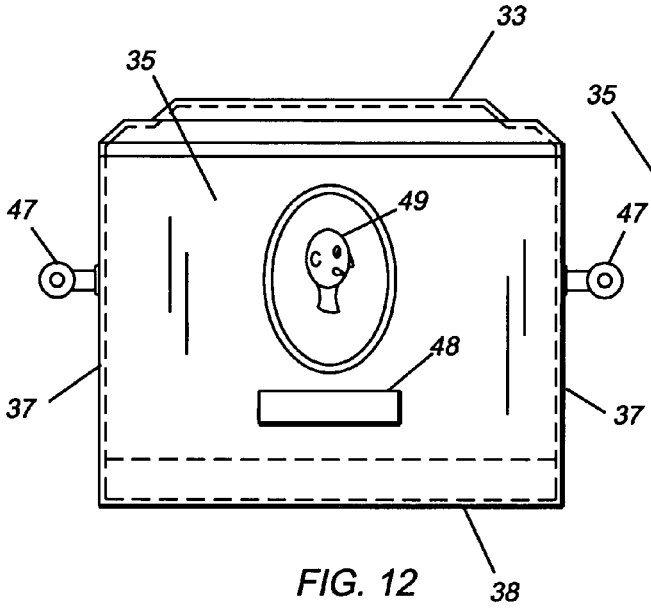
FIG. 12 is a front view of the deluxe embodiment.
Figure 13:
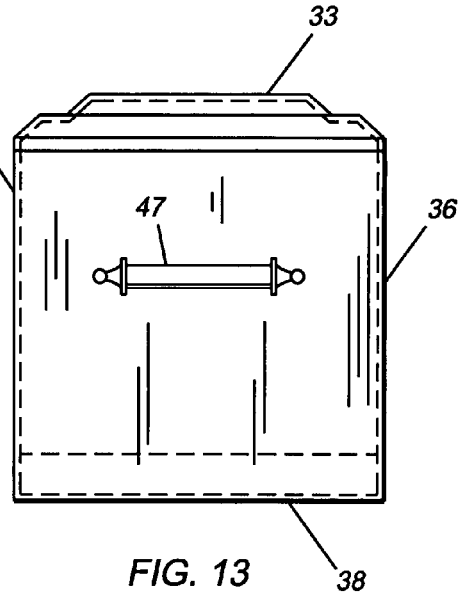
FIG. 13 is a left elevational view of the deluxe embodiment.
Figure 14:
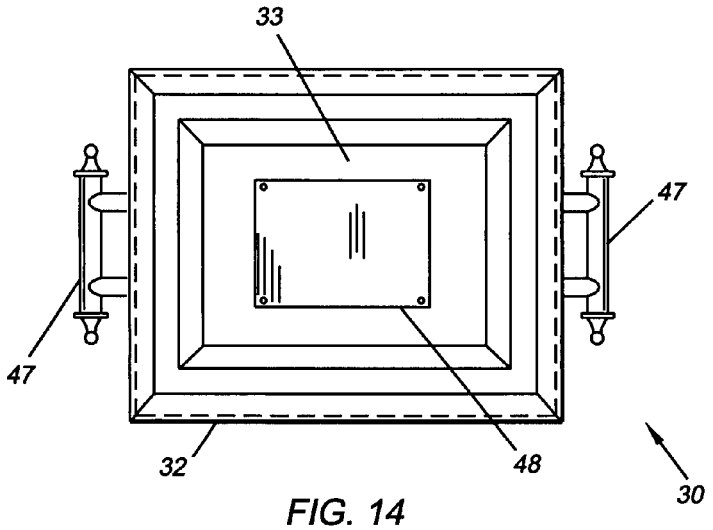
FIG. 14 is a plan view of an embodiment flagstone faces.
Figure 15:
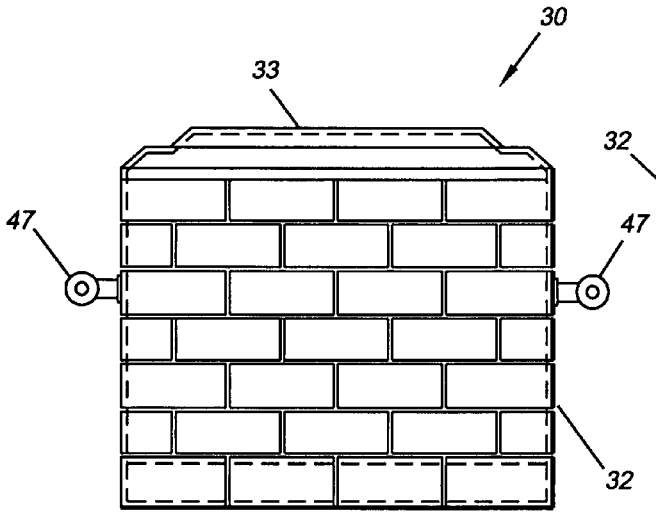
FIG. 15 is a front view of the flagstone embodiment.
Figure 16:
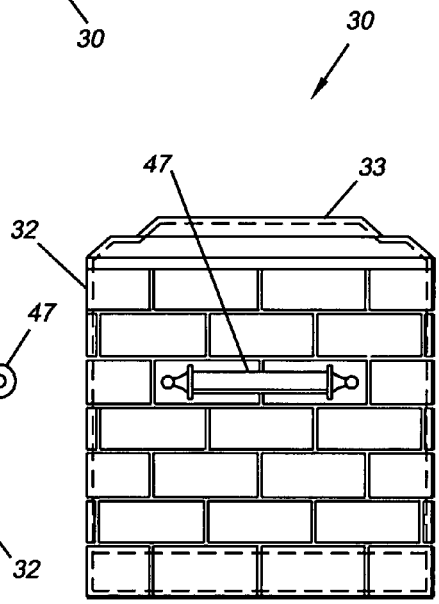
FIG. 16 is a left elevational view of the flagstone embodiment.
Figure 17:
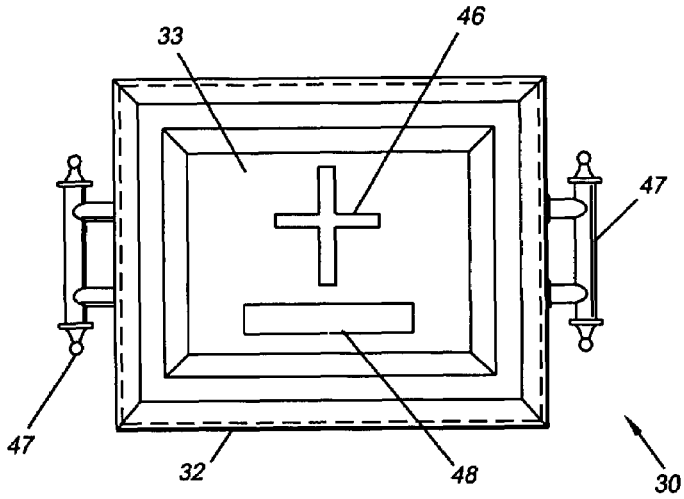
FIG. 17 is a plan view of an embodiment with irregular flagstone faces.
Figure 18:
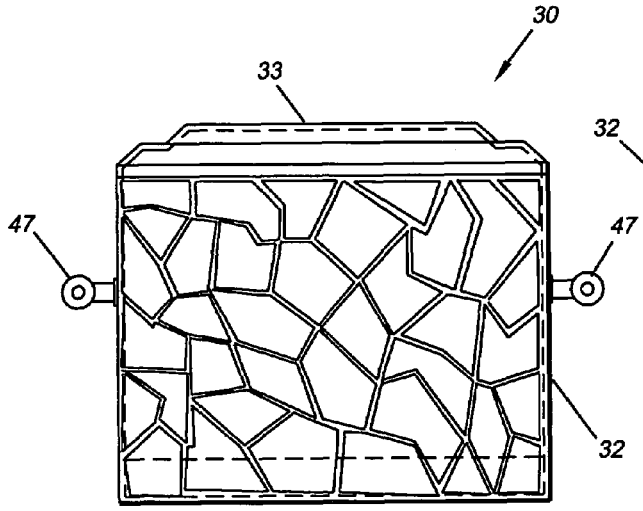
FIG. 18 is a front view of the irregular flagstone embodiment.
Figure 19:
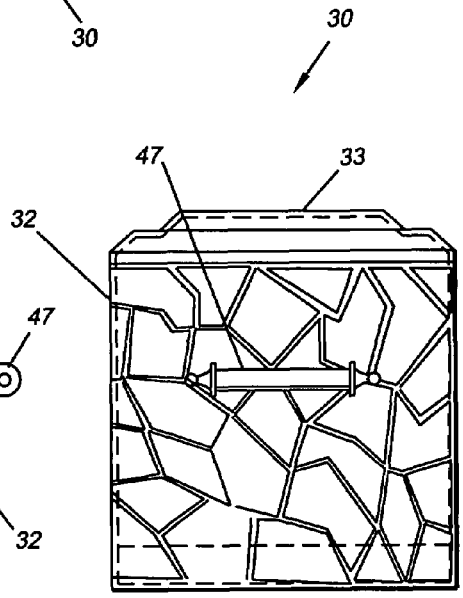
FIG. 19 is a left elevational view of the irregular flagstone embodiment.

Referring now to FIGS. 11 through 19, enhancements of the vault 32 and urn 31 of FIGS. 1 through 10 are shown for demonstrating the versatility of my invention. In FIGS. 11 through 13, a religious inscription 46 has been added on the cover 33 of the vault 32, a pair of handles 47 on the sides 37 and a name plate 48 and image 49 of the deceased on the front In FIGS. 14 through 16, a name plate 48 has been added to the cover 33. The front 35, rear 36 and sides 37 of the vault 32 are covered with simulated cut stone or simulated brick. In the embodiment shown in FIGS. 17 through 19, simulated irregular field stone is applied in the previously described manner to the front 35, rear 36 and sides 37 of the vault 32 and a religious inscription 46 and name plate 48 are applied to the cover 33.

Figure 21:
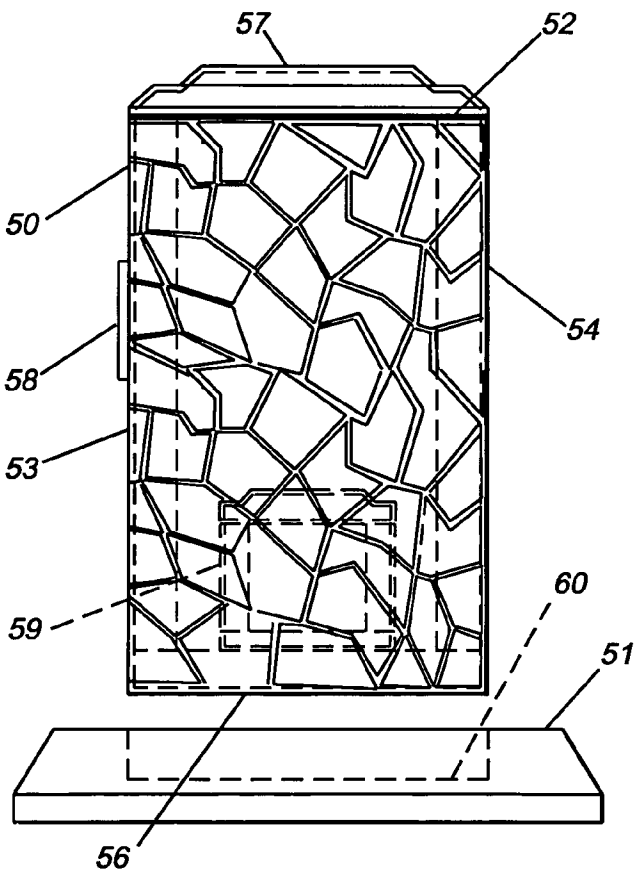
FIG. 21 is a left elevational view of the simulated gravestone vault.
Figure 20:
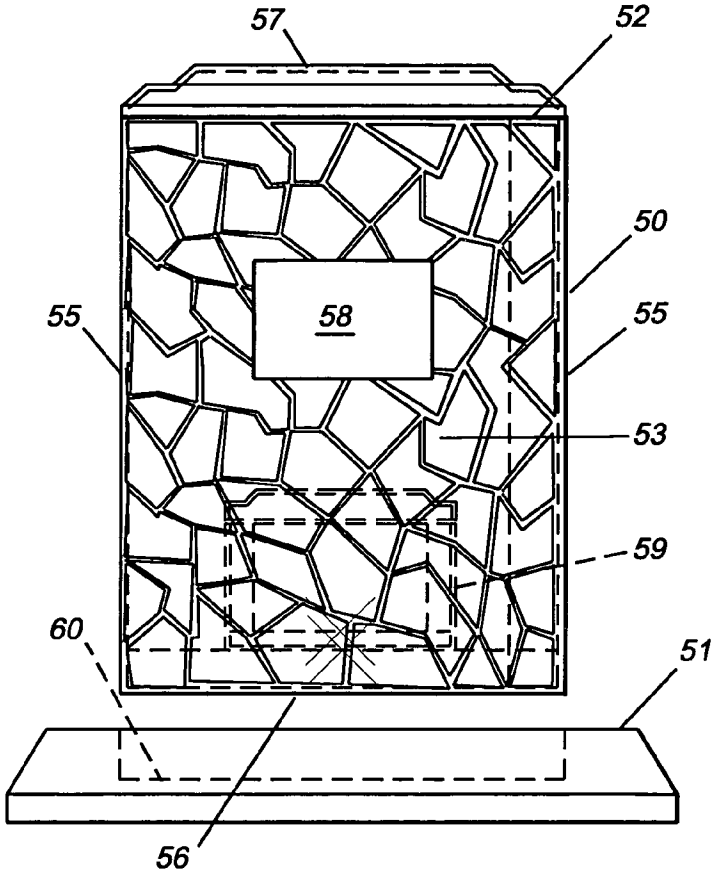
FIG. 20 is a front view of an embodiment with a simulated gravestone vault.
Figure 22:
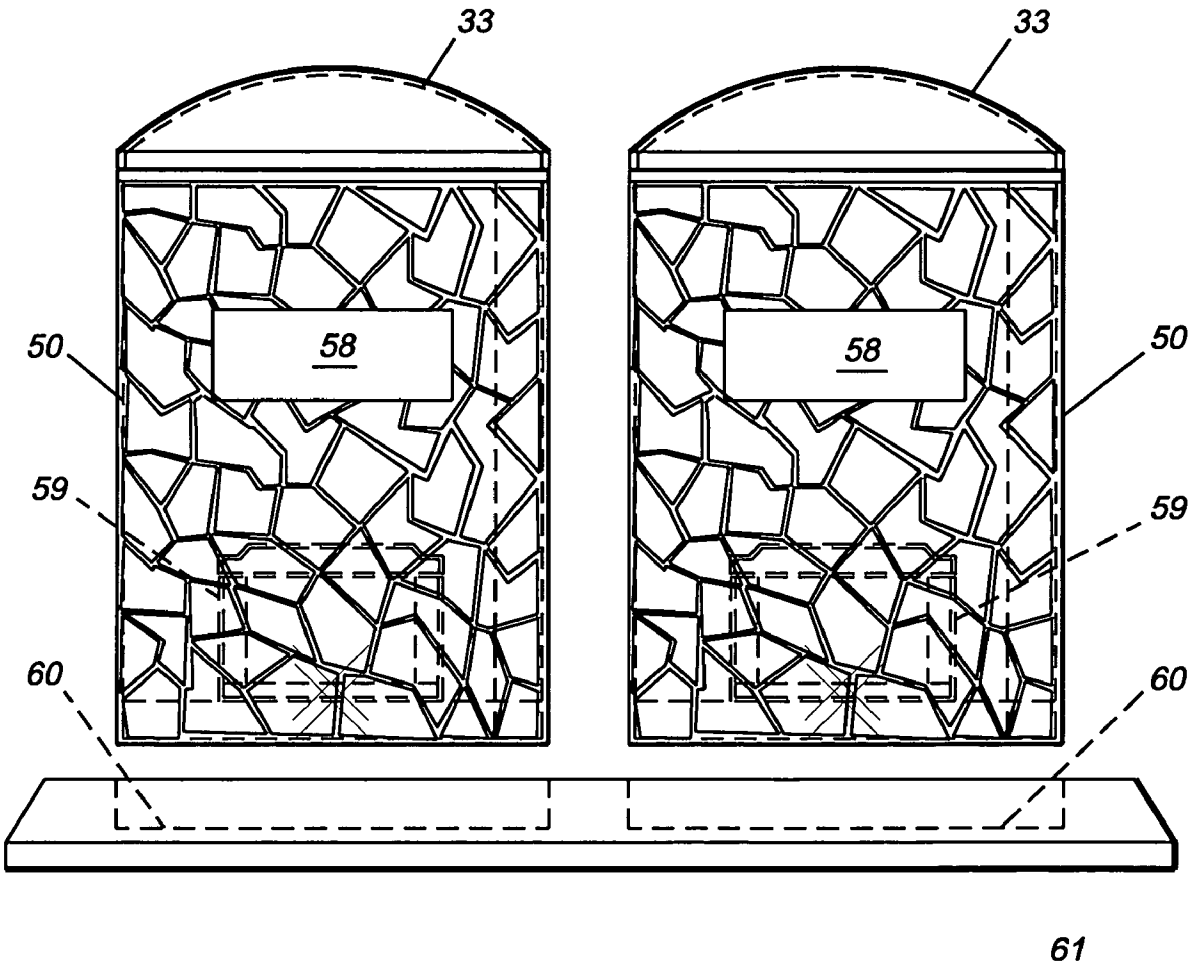
FIG. 22 is a front view of a pair of simulated gravestone vaults.

Referring now to FIGS. 20 and 21, a vault 50 is shown which simulates the appearance of a traditional grave site monument, or in the alternative a grave site marker (not shown) made of irregular shaped field stone. The simulated grave site monument 50 is a weather resistant enclosure mounted in a pre-cast concrete base 51. The vault 50, constructed according to the afore-described methods, comprises open top 52, front 53, rear 54, side 55 and bottom 56 portions and an adhesively attached cover 57. On the front 53 of the simulated grave site monument 50 there is an inscribed identification plate 58 or plaque containing the name, birth date, date of death of the decedent and affectionate sayings, if any. In the interior there is a cremation urn 59 which is installed before the cover 57 is adhesively attached. In the pre-cast base 51 there is a pocket 60 that locates the simulated grave site monument 50. The grave site monument 50 is preferably installed in liquid cement, such as "thin set" cement to secure the simulated monument 50 to the base 51. In FIG. 22, a pair of the simulated grave site monuments 50, containing the cremated remains of a husband and wife, are mounted, side-by-side, in the pockets 60 of a common pre-cast concrete base 61.

From the above, it is apparent that my invention provides an improved means for dignifying, honoring and preserving the cremated remains of humans and pets. One important benefit is that a variety of aesthetically pleasing styles can be provided without incurring significant cost penalties. Still yet another benefit is that it provides a durable weatherproof outdoor closure for preserving cremated remains. Still yet another benefit is that it can be used to simulate a grave site monument or marker for honoring the cremated remains of a deceased person or pet.

Although only several embodiments of my invention have been illustrated and described, it is not my intention to limit the invention to the disclosed embodiments. It will be appreciated that other embodiments can be derived from my disclosure by changes which are obvious and/or well known to persons skilled in the relevant art, such as substitutions of materials and/or parts, elimination of parts, re-arrangements of parts and inversions of parts without departing from the spirit thereof.

What is claimed is:

1. An aesthetically pleasing urn for honoring the cremated remains of a person or pet during a memorial service and preserving said remains, comprising: open top, front, sides, rear and bottom portions made from a rigid plastic polyfoam material covered with a weather resistant coating, and a rigid plastic polyfoam cover for hermetically sealing said urn after said cremated remains are inserted into said urn, a reinforcing cloth adhesively bonded to outer surfaces of said urn and said cover; and an overlying decorative weatherproof coating on top of said reinforcing cloth of said urn.

2. The urn recited in claim 1 wherein said outer decorative coating simulates a marble urn.

3. The urn recited in claim 1 wherein said outer decorative coating simulates a cut stone urn.

4. The urn recited in claim 1 wherein said outer decorative coating is a thick mixture of a cement type coating and colorant.

5. The urn recited in claim 1 wherein said outer decorative coating is a composite finish containing an acrylic polymers and a filler material.

6. The urn recited in claim 1 wherein said front, rear, side and bottom portions of said urn are portions of a unitary structure molded from said plastic polyfoam material.

7. The urn recited in claim 1 wherein said front, rear and side portions of said urn are cut with a hot wire from a block of said plastic polyfoam material.

8. In combination with an urn for preserving the cremated remains of a person or pet, a weatherproof vault for storing said urn, said vault comprising open top and front, sides, rear and bottom portions made from a rigid plastic polyfoam material; a rigid plastic polyfoam cover adhesively attached to said open top of said vault for hermetically sealing said vault after said urn with cremated remains are inserted into said vault, a reinforcing cloth adhesively bonded to outer surfaces of said vault and said cover; and an overlying decorative weather resistant coating on top of said reinforcing cloth of said vault and said cover.

9. The combination set forth in claim 8 further comprising a decorative fabric liner in the interior of said vault.

10. The combination set forth in claim 8 further comprising a plate on an outer-surface of said vault, said plate having an inscription designating the name, date of birth and date of death of a cremated person or pet whose cremated remains are in said urn.

11. The combination set forth in claim 8 further comprising a religious saying or honorary inscription on an outer surface of said urn.

12. The combination set forth in claim 8 wherein said vault has the appearance of a traditional grave site monument further comprising a religious saying or honorary inscription on an outer surface of said urn.

13. The combination set forth in claim 12 further comprising a pre-cast concrete base for supporting said simulated grave site monument.

14. The combination set forth in claim 13 further comprising a second grave site monument mounted on said base in a side-by-side relationship to said other simulated grave site monument.

15. A weatherproof hollow vault for storing an urn containing the cremated remains of a person or pet, said vault resembling a traditional grave site monument and having a rigid polyfoam plastic core; and a cover wherein said urn is installed in said vault; an outer weatherproof decorative simulated masonry coating covering said polyfoam plastic core and said cover; and a decorative fabric liner in an interior of said hollow vault.

16. The vault described in claim 15 wherein said outer weatherproof decorative simulated masonry coating is troweled on to said polyfoam plastic core and said cover.

17. The vault described in claim 15 wherein said outer weatherproof decorative simulated masonry coating is sprayed on to said polyfoam plastic core and said cover.

* * * * *